United States Patent [19]

Linton

[11] Patent Number: 4,650,069

[45] Date of Patent: Mar. 17, 1987

[54] PROTECTIVE POCKET PEN CLIP WITH STABILIZING NOTCHES

[76] Inventor: Thomas Linton, 1701 1st St. SW., New Brighton, Minn. 55112

[21] Appl. No.: 734,342

[22] Filed: May 14, 1985

[51] Int. Cl.[4] ..... B43K 25/00

[52] U.S. Cl. ..... 206/37; 24/11 CT; 206/371; 206/372; 206/443; 206/476; 211/69.1

[58] Field of Search ..... 206/37, 38, 371, 372, 206/214, 224, 334, 476, 443; 224/230, 231; 24/10 R, 11 HC, 3 H, 11 CT; 211/69.1

[56] References Cited

U.S. PATENT DOCUMENTS

| | | | |
|---|---|---|---|
| 473,230 | 4/1892 | Lane | 24/11 CT |
| 894,448 | 7/1908 | Kruschke | 24/11 CT |
| 1,072,730 | 9/1913 | Humphrey | 24/11 CT |
| 1,221,715 | 4/1917 | Floyd | 24/11 HC |
| 1,670,204 | 5/1928 | Moore | 206/476 X |
| 2,417,786 | 3/1947 | Smith | 206/37 R |
| 2,616,138 | 11/1952 | Albro | 24/10 R |
| 2,890,507 | 6/1959 | Rainwater, Jr. | 24/3 H |
| 2,913,789 | 11/1959 | Loredo | 24/10 R |
| 3,178,784 | 4/1965 | Krauthamer | 24/10 R |

FOREIGN PATENT DOCUMENTS

| | | | |
|---|---|---|---|
| 7272 | of 1909 | United Kingdom | 24/11 C |

*Primary Examiner*—William Price
*Assistant Examiner*—Bryon Gehman
*Attorney, Agent, or Firm*—Kinney & Lange

[57] ABSTRACT

A pocket protector clip is formed to fit over the edge of a shirt or coat pocket to protect the edges of the pocket from marking or damage and keep a pen or pencil oriented properly when the pen or pencil is clipped on to the protector clip. The protector clip has two panels, joined at first edges, and one panel is placed on each side of the pocket cloth panel. The inside clip panel has notches for receiving the remote portion of the barrel of pens or pencils which are clipped on the protector clip, to stabilize the barrel in position on the protector clip.

7 Claims, 6 Drawing Figures

PROTECTIVE POCKET PEN CLIP WITH STABILIZING NOTCHES

BACKGROUND OF THE INVENTION

1. Field of the Invention

The present invention relates to protective clips or members for protecting the edges of shirt pockets or the like from wear when a pen or pencil is clipped into place.

2. Description of the Prior Art

Various plastic protectors have been advanced, where a plastic pocket is formed and slips inside a shirt pocket, and has a panel that goes on the outside of the shirt pocket. These plastic protectors are fairly large, and form a separate insert pocket. Generally they are quite obtrusive to the eye when placed onto a shirt pocket, and are not satisfactory for a wide variety of uses.

The present protective device is easily made, is attractive, and can be used for embossing directly on the front panel has a convenient location for advertising messages.

SUMMARY OF THE INVENTION

The present invention relates to a protective clip for protecting the edges of a pocket from damage when a pen or pencil is clipped onto the pocket. The protector clip is made in a simple u-shaped form having two panels that are connected at one end by a bend portion and with the free ends of the panels resiliently engaged together, so that the clip member can be slid over the edge portion of a pocket, and then a pen or pencil clipped onto the protector clip member with the barrel of the pen or pencil on the inside of the pocket. The panel of the protective clip member that is positioned on the inside of the pocket includes grooves or recesses that will receive and stabilize the barrel of such pen or pencil and permit it to be held securely.

The front panel of the protective clip member provides a space for the user's initials or for advertising. The clip can be plated in attractive gold color so that it is formal looking and at the same time decorative, while it fulfills the purpose of protecting the pocket.

DETAILED DESCRIPTION OF THE PREFERRED EMBODIMENT

Figure 1:
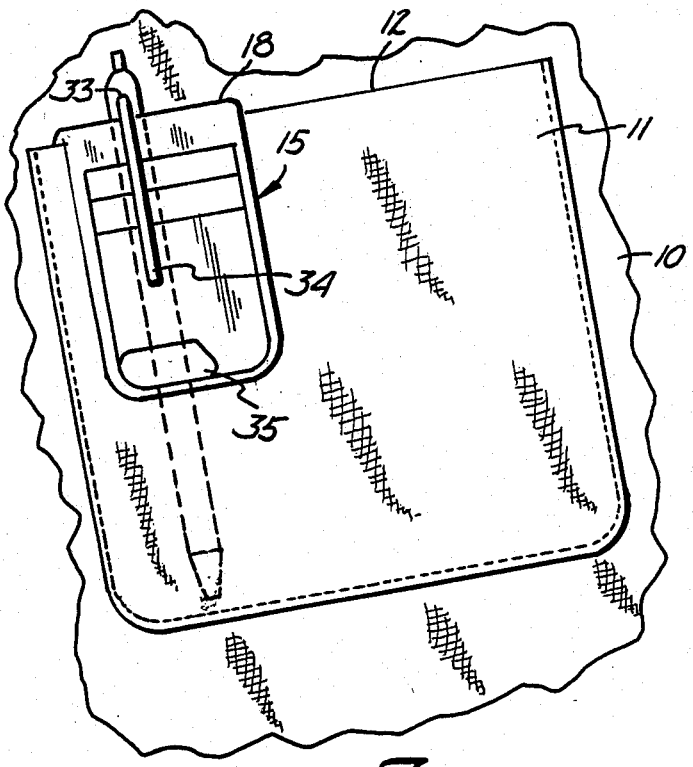
FIG. 1 is a front perspective view of a shirt pocket showing a clip made according to the present invention in place thereon and holding a pen in place.

As shown in FIG. 1, a shirt fabric indicated generally at 10 has a cloth pocket panel 11 forming a pocket in a conventional manner. A protective clip member indicated generally at 15 made according to the present invention is positioned over the upper edge 12 of this pocket panel. The protective clip as shown has a first or front panel 16, and a second or rear panel 17. The front and rear panels 16 and 17 are joined together along an upper edge indicated at 18, which is a bent over junction.

The protective clip member 15 is formed by taking a relatively thin strip of metal, such as beryllium copper that is gold plated for decorative purposes, and bending it in a die to form the bend portion, so that the front and rear (first and second) protective clip panels 16 and 17 are very closely spaced at the edge portion 18 (the bend is thin enough to permit a pen or pencil to be clipped in place) and are contiguous adjacent to their opposite edge portions indicated generally at 22. The free ends of the front and rear panels are spring loaded together when formed.

The front panel 16 has embossed rib design made of ribs such as those shown at 23, which are formed in a conventional manner. The embossed ribs provide a space for placing labels of different types, such as adhesive initial labels (for a personalized clip) in the general area shown at 25. Advertising also could be placed in this region. The cross embossed ribs shown at 26 provide a rib surface to aid in retaining a pen in place (or pencil). The ribs also provide attractive appearance, and interesting designs can be embossed on thin beryllium copper.

The beryllium copper is relatively springy and will tend to be resiliently loaded together at the free edges 22 of the front and rear panels.

Figure 2:
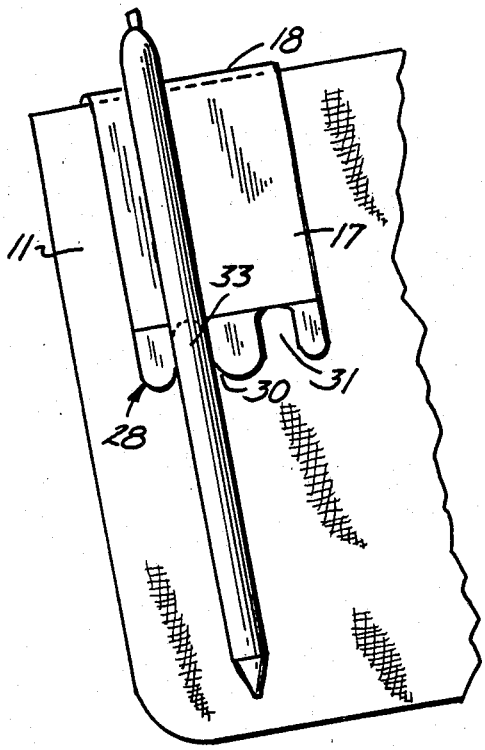
FIG. 2 is a rear view of the device of FIG. 1.
Figure 3:
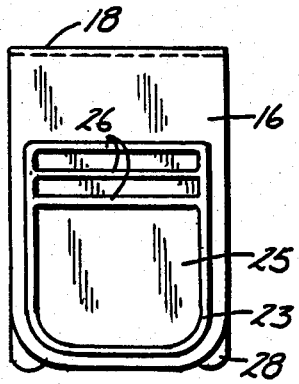
FIG. 3 is a front elevational view of a protective clip made according to the present invention.
Figure 4:
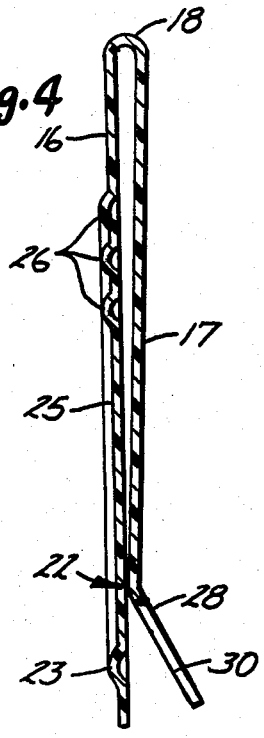
FIG. 4 is an enlarged sectional view taken as on line 4—4 in FIG. 5.
Figure 5:
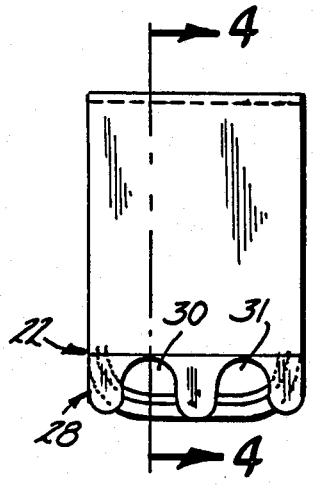
FIG. 5 is a rear view of the device made according to the present invention.
Figure 6:
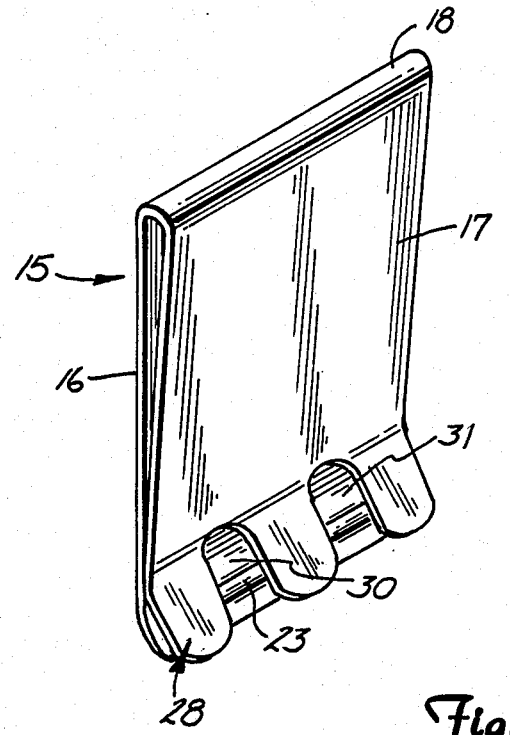
FIG. 6 is a perspective view of the device of the present invention showing the writing instrument retaining notches.

The rear panel 17, as shown, has an outer end panel portion adjacent the second or free edge thereof (remote from the bend portion at edge 18) indicated generally at 28, which is bent out of the plane of the second panel 17, in direction away from the first or front panel 18. The bend portion is bent at an angle of about 40° relative to the plane of second panel 17. Bent panel portion 28 has first and second grooves or notches 30 and 31 formed therein which are of size to receive a ball point or fountain pen (or a pencil) indicated generally at 33. The pen or pencil has a pen clip 34 clipped over the upper edge of the protective clip member 15 and with the pen body nested in one of the notches 30 or 31, as shown in notch 30 in FIG. 2, the pen is held, oriented properly and is prevented from moving from side to side, so it is guided in upright position in the pocket. The pen or pencil end cannot move from side to side and thus will not tend to wear on the pocket panel.

These notches 30 and 31 also maintain the pen in a proper orientation, so that if it is a ball point, it cannot mark the interior of the pocket or the shirt fabric by sliding back and forth if it accidentally is left extended. The protective clip member will not be worn by pen movement either. The pen clip 34 thus will not damage the finish on the front panel.

If course, instead of a pen as shown at 33, various pencils having pencil clips corresponding to the clip 34 thereon also can be utilized. In the claims, the term "elongated writing instrument" is intended to cover various types of writing members such as a pen or pencil that has a writing instrument clip that will fit over the closed end of the protective clip and which has a barrel type body that fits in one of the notches 30 or 31 to keep the writing instrument oriented uprightly.

The plating on the beryllium copper protective clip can be any type, but generally for attractive appearance a thin gold plating or electroplating would be carried out.

As shown in FIG. 1, a label plate 35 can be provided for an emblem that can be adhesively attached to the front or first panel 16 in the region 33 for personalized initials.

The protective clip is quickly and easily formed, and is a low cost way of providing an advertising or give-away premium. In general size, the unit can be one and three eighths inches wide and have a depth or length of a little over two inches. The notches 30 and 31 are cut to be of size to permit holding two pens side by side, and to fairly snugly receive a standard size pen barrel. The bent portion at the end of second panel 17 provides the side edges of the notches in position to engage the sides of the pen or pencil (elongated writing instrument) to prevent the unwanted side-to-side movement.

What is claimed is:

1. A protector clip member for holding at least one elongated writing instrument having an elongated barrel body and an instrument clip adjacent one end of the body, with the protector clip member in position over an edge portion of a cloth panel, comprising:

a wear resistant resilient protector clip member having a first panel and a second panel each having a plurality of edges;

means for joining first edges of the panels together, the other edges of said panels being unconnected, and adjacent to form a resilient U shaped clip with the panels being substantially contiguous adjacent the edges opposite from the first edges;

the means joining the first and second panels at the first edges being sufficiently thin to permit an instrument clip of an elongated writing instrument to be clipped over the joined edges; and the second panel having an edge portion at the edge opposite from the means joining the first edges, said edge portion of the second panel being bent out of the plane of the second panel in a direction away from the first panel, and having at least one notch defined therein of a size to receive and stabilize a barrel of an elongated writing instrument remote from an instrument clip when such as elongated writing instrument is mounted on the protector clip member with the instrument clip thereof overlying the first panel.

2. The protector clip of claim 1 wherein there are two separated notches formed in the edge portion of the second panel.

3. The protector clip of claim 1 wherein said means for joining comprises a bend portion of a unitary strip of material which also forms the first and second panels.

4. The protector clip of claim 3 wherein the unitary strip is made of a resilient springy material.

5. The protector clip of claim 4 wherein the unitary strip is beryllium copper.

6. The protector clip of claim 1, and raised rib members formed on the first panel transversely to tend to retain an instrument clip from sliding upwardly when an instrument is clipped in placed on the protector clip.

7. The protector clip of claim 1, and raised rib members on the first panel to define a desired design on the first panel.

* * * * *